US006645621B1

(12) United States Patent
Cordes et al.

(10) Patent No.: US 6,645,621 B1
(45) Date of Patent: Nov. 11, 2003

(54) DISCONTINOUS POLYETHYLENE TEREPHTHALATE FIBRES AND METHOD FOR PRODUCING THE SAME

(75) Inventors: Ingo Cordes, Maintal (DE); Christian Kellner, Maintal (DE); Ulrich Mirwaldt, Maintal (DE); Dietmar Wandel, Hanau (DE)

(73) Assignee: Lurgi Zimmer AG, Frankfurt am Main (DE)

( * ) Notice: Subject to any disclaimer, the term of this patent is extended or adjusted under 35 U.S.C. 154(b) by 0 days.

(21) Appl. No.: 10/031,467

(22) PCT Filed: Jul. 20, 2000

(86) PCT No.: PCT/EP00/06923

§ 371 (c)(1),
(2), (4) Date: May 21, 2002

(87) PCT Pub. No.: WO01/07693

PCT Pub. Date: Feb. 1, 2001

(30) Foreign Application Priority Data

Jul. 22, 1999 (DE) ..... 199 34 551

(51) Int. Cl.[7] ..... D01F 6/00

(52) U.S. Cl. ..... 428/364; 428/395; 264/103; 264/210.5; 264/210.8

(58) Field of Search ..... 428/364, 395; 264/103, 210.5, 210.8

(56) References Cited

U.S. PATENT DOCUMENTS 4,159,617 A 7/1979 Allan ..... 57/247
5,403,659 A * 4/1995 Nelson et al. ..... 428/364
5,782,935 A 7/1998 Hirt et al. ..... 8/512
6,576,339 B1 * 6/2003 Cordes et al. ..... 428/395

FOREIGN PATENT DOCUMENTS

GB 1 254 826 A 11/1971
WO WO 95 22650 A 8/1995

OTHER PUBLICATIONS

Patent Abstracts of Japan, vol. 1999, No. 12, (Oct. 29, 1999) & JP 11 189938 A (Toray Ind Inc), (Jul. 13, 1999).

Patent Abstracts of Japan, publication No. 11–189938, publication date Jul. 13, 1999 of application #09–355727, application dated Dec. 24, 1997 of Toray Ind Inc.

* cited by examiner

*Primary Examiner*—N. Edwards
(74) *Attorney, Agent, or Firm*—Norris McLaughlin & Marcus

(57) ABSTRACT

PTT staple fibers which are characterised by a novel combination of properties. In combination with novel stress-strain properties and modulus parameters, staple fibers or textiles or home textiles having extremely desirable aesthetics and service quality are obtained.

Economical two-stage process for the production of PTT staple fibers. The melt spinning is carried out at a high polymer throughput and a spinning take-off speed of at least 600 m/min. In a separate fiber drawing frame, the stretching, heat-setting, crimping and drying are carried out.

8 Claims, No Drawings

DISCONTINOUS POLYETHYLENE TEREPHTHALATE FIBRES AND METHOD FOR PRODUCING THE SAME

The present invention relates to PTT staple fibres [where PTT equals poly(trimethylene terephthalate)] and to a process for the production thereof by a two-stage spinning and stretching process.

Staple fibres made from polyethylene terephthalate and melt-spinning plants for their production are known (Fourné, Synthetische Fasern [Synthetic Fibres], Hanser Verlag [1995] pages 460–462). Owing to the different crystallization behaviour, these processes cannot readily be applied to PTT.

Processes for the production of PTT continuous filaments have also been described. Thus, Journal of Polymer Science, Part A-1, Vol. 4, 1851–1857 (1966) mentions, inter alia, PTT fibres. The high stretching ratios specified indicate an uneconomically low spinning speed. The fibre properties listed do not meet today's market requirements.

EP 0 547 553 A1 describes the production of monofilaments at a spinning speed of 20 m/min and a production speed of 100 m/min.

EP 0 754 790 A2 describes the production of textile filaments, inter alia from PTT, by means of heating surfaces heated to high temperatures as stretching aids. There are no specific working examples.

WO 99/11845 A1 describes fibres made from PTT with a birefringence of at least 0.030. The parameters given indicate low elongation at break values of ≦90%, which do not facilitate a stretching ratio that is sufficiently high for further conversion into staple fibres and are therefore unsuitable.

WO 99-27168 A1 discloses a high-speed spin-stretch process for the production of PTT filaments which are wound onto yam spools. High throughputs and tow baling for the production of staple fibres cannot be derived therefrom.

CA 86:122866 regarding JP 52-08124 A relates to the treatment of PTT multifilaments with heating devices, where the stretching ratio of 33% to be applied is unsuitable for the production of staple fibres.

CA 86:122865 regarding JP 52-08123 A describes the use of a high stretching ratio of 300%, which is desired per se, in the production of PTT fibres. However, the spinning speed of 360 m/min which is practised to this end is so low that the economic efficiency of the process is put in doubt.

CA 86:122856 regarding JP 52-05320 A describes the spinning of PTT, where the stretching ratio practised indicates uneconomically low spinning speeds.

The object of the present invention is to provide PTT staple fibres, where these and the textiles and home textiles, in particular carpets, produced therefrom should have a high aesthetic level and service quality compared with conventional fibres and should have environmentally friendly dyeing properties. These PTT staple fibres should be produced in a two-stage process of melt spinning and stretching which has higher economic efficiency than the above-mentioned processes for continuous filaments.

This object is achieved in accordance with the invention by PTT staple fibres and by a process for the production of PTT staple fibres having an intrinsic viscosity of at least 0.70 dl/g as described in the patent claims.

The term PTT here is taken to mean a polyester comprising at least 90 mol% of trimethylene terephthalate units. Suitable comonomers are isophthalic acid, 2,6-naphthalenedicarboxylic acid, ethylene glycol, diethylene glycol, 1,4-butanediol and 1,4-cyclohexanedimethanol. Preference is given to poly(trimethylene terephthalate) homopolymer, particularly preferably with a low proportion of ether groups derived from 1,3-propanediol which are formed during the production process. The intrinsic viscosity of the PTT staple fibres is in the range from 0.7 to 1.3 dl/g and particularly preferably from 0.75 to 1.15 dl/g.

The process commences from PUT melt, which is either taken directly from the polycondensation reactor in the preparation of PTT or is obtained by melting PTT granules. The polymer melt may comprise conventional additives, such as dyes, matting agents, stabilisers, antistatics, lubricants and branching agents, in total amounts of from 0 to 5.0% by weight, or the additives can be added to the melt on its way to the spinnerets. Additives which significantly affect structural parameters (for example elongation at break of the strand) are excluded.

In accordance with the invention, PTT staple fibres are produced, preferably with a titre of from 0.8 to 20 den, by a two-stage spinning and stretching process which comprises the following steps:

1. The PTT melt, having a polymer melting point $T_m$, is fed to the spinning system at a melt temperature $T_S=T_m+k$ (° C.), where $7 \leqq k \leqq 63$, preferably $2 \leqq k \leqq 41$. The transport and distribution of the melt as far as the spinning beam take place here in jacketed product lines, which are heated with liquid and/or vapour-form heat transfer medium in the outer jacket of the lines at a temperature in the range from 234 to 290° C. Other types of heating are possible. The wall shear rates of the melt in the line system are from 2 to 128 $sec^{-1}$, preferably from 3.5 to 16 $sec^{-1}$, in the pipelines and from 12 to 128 $sec^{-1}$ in static mixing elements installed within certain line sections. The shear rate γ here is defined by the empty pipe shear rate times the mixer factor m, where the mixer factor is a characteristic parameter of the mixer type and is about 3.5–4 for Sulzer SMXL models. The shear rate γ in $sec^{-1}$ is calculated from $$\gamma\gamma = \frac{4 \cdot 10^3 \cdot G}{\pi \cdot \delta \cdot R^3 \cdot 60} \cdot m$$

where G=polymer transport rate (g/min),

δ=nominal density of the polymer (g/cm$^3$),

R=empty pipe radius [mm].

The mean residence time of the melt in the product line as far as entry into the spinning beam is a maximum of 30 minutes, preferably a maximum of 25 minutes. The line temperature $T_1$ is preferably set within the above limits in such a way that it is in the range $T_1=T_S \pm 15°$ C. The product line optionally includes at least one booster pump, at least one polymer filter, at least one polymer heat exchanger and at least one shut-off and distribution valve.

2. In the spinning beam, the PTT melt is fed to at least one spinning pump, fed at a constant transport rate, set through the choice of the pump speed, to at least one spin pack by means of the pressure built up by the pump and forced through distributor devices, filter and shear media within the spin pack and spun through the holes of the spinneret plate to give melt strands. The spinneret holes may be circular or designed in any desired other geometry.

The spin pack can be inserted into the spinning beam from below and can have a cylindrical geometry, with the holes in the spinneret plate being distributed symmetrically over an annular area.

The spinneret plates have a hole density of from 0.3 to 20 holes/cm$^2$. The spinneret hole diameter D is selected as a function of the hole throughput in accordance with $$\sqrt[2]{\frac{F(g/\min)}{\zeta(g/cm^3)\cdot\pi\cdot 2}} \geq D(mm) \geq \sqrt[2]{\frac{F(g/\min)}{\zeta(g/cm^3)\cdot\pi\cdot 7}}$$

where ζ is the density of the melt and, for homo-PTT, is 1.11 g/cm$^3$.

The flow rate F per spinneret hole, based on the fibre titre, is in the range F(g/min)/titre(dtex)=(0.14 to 0.66).

The residence time of the melt in the spin pack is at most 4 minutes. The spinning draft is selected between 1:30 and 1:160 and is determined in a known manner from the ratio of the take-off rate to the injection rate at the spinneret holes.

The heating of the spinning beam is selected in the range 234–290° C. in such a way that the following relationship applies: $T_B$ (° C.)=$T_S$+d$T_W$+4/100 dp(bar)±15, where d$T_W$= change in the melt temperature in the heat exchanger, which is set positive for heating and negative for cooling and is equal to 0 in the case of plants with no heat exchanger, dp(bar)=total pressure drop of the melt as far as the exit from the spinneret plate.

3. The melt strands are cooled by means of turbulence-free cooling air at a temperature between 5 and 25° C., preferably from 8 to 18° C., flowing in perpendicularly to the strand running direction. The mean outflow speed of the cooling air from the rectifier is from 0.5 to 2.0 m/sec. The blow zone lengths are between 50 and 2000 mm, preferably from 150 to 600 mm, in the case of cooling-air systems which are concentric to the strand run (radial blowing) and from 500 to 2000 mm in the case of blow shafts with cross-flow blowing, and particularly preferably 150–300 mm for fibre titres ≦5 den/filamnent and from 300 to 600 mm for 12–20 den/filament.

4. The cooled strands are finished with an oil-water mixture. The amount of water on the strands is adjusted to between 12 and 30% by weight, preferably from 18 to 25%.

Immediately or shortly thereafter, the filaments from a spinning position are gathered together to form a filament bundle. The filament bundles from the individual positions are subsequently combined to form a spun tow, preferably at the spinning wall. The spun tow is taken off at speeds in the range from 600 to 2000 m/min by means of a take-off unit, and the spun tow is then deposited in a can.

5. The cans are placed together to form a creel in a creel chamber held at a temperature of from 15° C. to 35° C., preferably from 20° C. to 27° C., and fed to a fibre drawing frame. The spun tow from the cans is taken off via a feed unit, after which at least one full tow is formed from individual spun tows by means of a comb.

The full tows are stretched in at least one stretching stage, optionally with supply of a temperature-controlled oil/water mixture. A temperature in the range 20–100° C. should be maintained here. The stretching ratio (SR) is selected in accordance with the strand elongation $R_d$ in such a way that SR(%)=1+α·$R_d$/100, where α=0.25 to 0.75, with relatively small α values being preferred for large titres and relatively large a values being preferred for smaller titres.

This is then optionally followed, depending on the maximum temperature of 210° C. used, by heat setting and relaxation in at least one stage. The stretching, heat setting and relaxation are carried out at speeds of from 25 to 400 m/min.

The discharge speed from the relaxation zone is preferably at least 90 m/min, particularly preferably 180 m/min, at titres ≦5 dtex.

The cooling of the full tow to below the glass transition temperature is preferably carried out using an oil/water mixture or using pure water.

6. The individual tows are subsequently laid together to form at least one tow, and each tow is fed to a stuffer box crimping machine. Post-softening using an oil/water mixture and/or steam treatment of the tow as crimping aid is optionally carried out. The subsequent drying of the tow in at least one dryer stage is carried out with residence times of from 0.5 to 10 minutes at temperatures of from 30 to 200° C., preferably from 60 to 165° C. The resultant tow(s) can subsequently be cut to a staple length of preferably between 6 and 200 mm. Alternatively, it is possible for the tow(s) to be packed and converted into staple fibres later in a separate operation.

In this way, PTT staple fibres are obtained which have a novel, hitherto unknown combination of properties for staple fibres which are evident as follows: high permanent elasticity and bulk of the fibres, a novel combination of high viscosity together with the mechanical parameters described by the stress-strain diagram, of modulus values and thermal shrinkage stability, with dyeing with dispersion dyes being possible without addition of carrier/dye absorption aids, and the fibres having permanently stain-repellent properties.

Characteristic features of the PTT staple fibres according to the invention are an LASE value at 10% elongation of from 5 to 12 cN/tex, a secant modulus at an elongation value=elongation at break minus 45% (but at least 5%) of less than 1.0 cN/tex per 1% change in elongation, and a crimp stability of greater than 75%. This combination of properties results in extremely desirable aesthetics and service quality compared with conventional fibres. The dyeing properties result in considerably better environmental friendliness of the post-processing process. The areas of application are to be regarded as being in textiles and home textiles, in particular carpets.

The invention is explained in greater detail below with reference to examples without the invention being restricted to these working examples.

EXAMPLE 1

PTT chips having an I.V. of 0.93 dl/g, a melting point $T_M$=227° C. and a water content of 20 ppm were melted in an extruder to give a melt at 255° C., and this melt was forced through a product line at the same temperature into a spinning system. Three SMXL mixers from Sulzer, Switzerland, were installed in the product line, with the shear rate in the mixers being 28 sec$^{-1}$ at a polymer throughput of 2500 g/min. The line diameter was selected so that the shear rate in the free line was 7.9 sec$^{-1}$. The mean residence time in the product line was about 3 minutes.

The spinning of the PTT melt was carried out in a BN 100 spinning system from Lurgi Zimmer AG with annular spinneret and radial cooling shaft. The hole density of the spinneret plate was 6.3 holes/cm$^2$. The spinning beam temperature was 256° C., with the total pressure drop of the melt as far as the exit from the spinneret being 140 bar. Heat exchangers were not installed. The residence time in the spin pack was about 0.5 minute.

The melt strands emerging from the spinneret plate were cooled by means of cooling air fed radially from the outside inward at a rate of 1400 Nm$^3$/h and with a temperature of 8° C. The solidified strands were brought into contact with an oiling ring at a distance of 850 mm from the lower side of the spinneret plate and treated with a water/oil mixture in such a way that the amount of water on the strands was about 25% by weight and very stable strand running resulted. The spinning take-off speed was 900 m/min. After being taken off, the strands were deposited in spinning cans in the form of spun tows by means of a reeling machine.

The separate stretching of the spun tows in a fibre drawing frame was carried out in two stages. The spun tows were subsequently heat-set with slight relaxation, cooled, crimped, dried and cut to give staple fibres. The production speed in the fibre drawing frame, corresponding to the speed of the roller at the exit from the final stretching zone, was 100 m/min.

Further process parameters and the textile properties of the staple fibres are shown in the table. It should be noted that the spinning titre measured may differ by up to ±5% compared with the theoretical value due to uncertainties in the measurement, relaxation in the can or a water/oil coating. It was possible to dye the staple fibres with dispersion dyes, such as Terasil Navy Blue GRL/C from Ciba/CH at 95° C. without addition of carrier/dye absorption aids.

The intrinsic viscosities (I.V.) were measured on a solution of 0.5 g of PTT in 100 ml of a mixture of phenol and 1,2-dichlorobenzene (3:2 parts by weight) at 25° C.

The melting point and glass transition temperature were determined by DSC at a heating rate of 10° C./min after the sample had firstly been melted briefly and immediately quenched again.

The titre and stress-strain properties of the fibres were determined using the Vibrotex and Vibrodyn instrument set from Lenzing, Austria. The clamped length was 20 mm, the pre-tensioning weight, depending on the titre, was 100 mg/dtex, and the test speed was 20 mm/min.

It was possible to take the LASE (load at specific elongation) values directly from the evaluation instrument by input of the reference elongations. The secant modulus was determined by applying a secant with the elongation value=(elongation at break minus 45%), but at least 5%, and the slope of these straight lines was evaluated in (cN/tex) in respect of a 1% change in elongation.

The hot-air shrinkage was determined in a heating cabinet during temperature treatment at 180° C. over a residence time of 20 minutes without pretensioning of the fibres.

The crimp curves were counted visually. The crimping values were determined using the Vibrotex method and instrument from Lenzing/AT.

EXAMPLE 2

Staple fibres were produced in carpet quality with a titre of 17 dtex as described in Example 1, but taking into account the parameters shown in the table, and the results are listed in the table.

The fibres were distinguished by excellent bulking and crimp-recovery behaviour.

Table

TABLE

| Example No. | | 1 | 2 |
|---|---|---|---|
| PTT melting point $T_m$ | ° C. | 227 | 227 |
| PTT glass transition temperature | ° C. | 46 | 46 |
| PTT I.V. | dl/g | 0.93 | 0.93 |
| Melting point $T_s$ | ° C. | 255 | 255 |
| Line temperature $T_1$ | ° C. | 255 | 255 |
| Shear rate line | $sec^{-1}$ | 7.9 | 7.9 |
| Shear rate mixer | $sec^{-1}$ | 28 | 28 |
| Temperature change in heat exchanger | dTw° C. | 0 | 0 |
| Total pressure drop | dp(bar) | 140 | 175 |
| Spinning beam temperature | ° C. | 256 | 256 |
| Spinneret plate hole density | $n/cm^2$ | 6.3 | 1 |

TABLE-continued

| Example No. | | 1 | 2 |
|---|---|---|---|
| Flow rate per spinneret hole | g/min | 0.668 | 4.15 |
| Spinning draft | 1: | 77 | 12 |
| Length of air-cooling zone | mm | 200 | 300 |
| Cooling air temperature | ° C. | 8 | 8 |
| Cooling air amount | $Nm^3/h$ | 1400 | 1500 |
| Mean cooling air speed | m/sec | 1.5 | 1.1 |
| Spin-finish concentration | % | 0.5 | 0.5 |
| Take-off speed | m/min | 900 | 800 |
| Fibre drawing frame feed speed | m/min | 32.8 | 19.2 |
| 1st stretching zone temperature | ° C. | 57 | 57 |
| Stretching zone stretching ratio | 1: | 2.7 | 3.4 |
| 2nd stretching zone temperature | ° C. | 70 | 80 |
| Stretching zone stretching ratio | 1: | 1.13 | 1.15 |
| Setting zone temperature | ° C. | 90 | 100 |
| Setting zone relaxation ratio | 1: | 0.94 | 1.00 |
| Relaxation zone discharge speed | m/min | 94 | 75 |
| Dryer temperature | ° C. | 70 | 150 |
| Dryer residence time | min | 2.5 | 2.5 |
| Overall stretching ratio | 1: | 3.05 | 3.91 |
| Actual relaxation ratio of the fibres | 1: | 0.90 | 0.74 |
| Strands | | | |
| titre | dtex | 7.87 | 50.6 |
| ultimate tensile strength | cN/tex | 13.9 | 10.7 |
| elongation at break | % | 314 | 613 |
| I.V. | dl/g | 0.90 | 0.90 |
| density | $g/cm^3$ | 1.3207 | 1.3178 |
| Staple fibres | | | |
| titre | dtex | 3.05 | 17.2 |
| CV titre | % | 5 | 5.3 |
| ultimate tensile strength | cN/dtex | 35.8 | 28.0 |
| elongation at break | % | 54.9 | 72.4 |
| CV elongation at break | % | 9.2 | 12.1 |
| LASE (2%) | cN/tex | 3 | 2.5 |
| LASE (5%) | cN/tex | 6 | 5 |
| LASE (10%) | cN/tex | 7.9 | 7.2 |
| secant modulus ($R_d$-45%) | cN/tex per 1% | 0.5 | 0.32 |
| number of crimp curves | n/cm | 11 | 13 |
| crimping value | % | 12 | 13 |
| crimp stability | % | 86 | 81 |
| hot-air shrinkage | % | 16 | 3 |
| cut length | mm | 38 | 150 |

The process described also enables the production of other titres, in particular finer titres, such as microfilaments of up to 0.8 den. The titre can thus be reduced by means familiar to the person skilled in the art by reducing the melt throughput through the spinneret or increasing the number of spinneret holes with constant throughput.

What is claimed is:

1. PTT staple fibres, having an intrinsic viscosity in the range 0.70–1.3 dl/g, an LASE (10%) of from 5 to 12 cN/tex, a secant modulus ($R_d$–45%) of <1.0 cN/tex per 1% and a crimp stability of >75%, said PTT staple fibres being dyeable with dispersion dyes without addition of carrier/dye absorption aids.

2. PTT staple fibres according to claim 1, further characterized by an intrinsic viscosity in the range from 0.75 to 1.15 dl/g and a titre in the range from 0.8 to 20 den.

3. Process for the production of PTT staple fibres having an intrinsic viscosity of at least 0.70 dl/g by a two-stage spinning and stretching process, wherein a) a PTT melt at a temperature $T_S$ (° C.)=$T_M$+k, where $T_M$ is the melting point of the PTT and 7£k£63, is fed through a product line heated at a temperature $T_1$ in the range from 234 to 290° C. by means of an external heat transfer medium to a spinning beam heated at $T_B$234 to 290° C. having, in the flow direction, at least one spinning pump, spin pack and spinneret plate having a hole density of from 0.3 to 20 holes/$cm^2$, and is spun through the at least one spinneret plate to give melt strands, with the mean residence time of the PTT melt being less than 30 minutes in the product line and a maximum of 4 minutes in the spin pack, and the spinning draft being from 1:30 to 1:160, and the flow rate F in g/min per spinneret hole, based on the fibre titre in dtex, being in the range from 0.14 to 0.66, b) the melt strands are cooled by means of turbulence-free cooling air at from 5 to 25° C. flowing in perpendicularly to the strand running direction at a mean air exit speed of from 0.5 to 2.0 m/sec and a blow zone length of from 50 to 2000 mm, and the cooled strands are treated with a water/oil mixture in such a way that from 12 to 30% by weight of water remain on the strands, and the strands are gathered together to form filament bundles, which are themselves combined to form spun tows, which are taken off at a take-off speed in the range from 600 to 2000 m/min and deposited in cans, c) the spun tows are taken off from the cans via a feed unit and comb and fed to a fibre drawing frame, in which they are stretched in at least one stretching stage at from 20 to 100° C., optionally heat-set at a maximum of 210° C. and relaxed, where the production speed is from 25 to 400 m/min, subsequently cooled to below the glass transition temperature and, after being combined to form at least one tow, crimped in one stuffer box crimping machine per tow, the tows are optionally post-treated with an oil/water mixture and then dried at from 30 to 200° C. over the course of from 0.5 to 10 minutes and finally cut to give staple fibres in a directly subsequent or separate operation.

4. Process according to claim 3, wherein $T_1=T_S\pm15°$ C. is within the range from 234 to 290° C., and the wall shear rate of the PTT melt in the product line is from 2 to 128 $sec^{-1}$.

5. Process according to claim 3 wherein the product line in stage a) optionally includes at least one static mixing element, booster pump, polymer filter, polymer heat exchanger and shut-off and distribution valve, and the wall shear rate of the PTT melt is from 3.5 to 16 $sec^{-1}$ in the free product line and from 12 to 128 $sec^{-1}$ in a static mixing element.

6. Process according to claim 3, wherein the spinneret hole diameter D is selected in accordance with $$\sqrt[2]{\frac{F(g/\mathrm{min})}{\zeta(g/\mathrm{cm}^3)\cdot\pi\cdot 2}} \geq D(\mathrm{mm}) \geq \sqrt[2]{\frac{F(g/\mathrm{min})}{\zeta(g/\mathrm{cm}^3)\cdot\pi\cdot 7}}$$

and $T_B(°\ C.)=T_S+dT_W+4/100\cdot dp(bar)\pm15$, where z is the density of the PTT melt, $dT_W$ is the change in the melt temperature in the heat exchanger, which is set positive for heating and negative for cooling, and dp(bar) is the total pressure drop of the melt as far as the exit from the spinneret plate.

7. Process according to claim 3, wherein the blow zone length is from 150 to 600 mm in the case of radial blowing and from 500 to 2000 mm in the case of cross-flow blowing.

8. Process according to claim 3, wherein the stretching ratio SR is set corresponding to $SR(\%)=1+a\cdot R_d/100$, where $R_d$ is the elongation in % of the strand, and a=0.25 to 0.75, and the discharge speed from the relaxation zone is at least 90 m/min.

* * * * *